US005079680A

United States Patent [19]

Kohn

[11] Patent Number: 5,079,680

[45] Date of Patent: Jan. 7, 1992

[54] UNDERSHELF TASK LIGHT FIXTURE

[75] Inventor: Mitchell B. Kohn, Highland Park, Ill.

[73] Assignee: Reflector Hardware Corporation, Melrose Park, Ill.

[21] Appl. No.: 712,084

[22] Filed: Jun. 7, 1991

[51] Int. Cl.[5] ..... F21V 7/12

[52] U.S. Cl. ..... 362/127; 362/223; 362/359

[58] Field of Search ..... 362/222, 221, 223, 224, 362/260, 297, 299, 303, 359, 127, 133, 125

[56] References Cited

U.S. PATENT DOCUMENTS

| | | | |
|---|---|---|---|
| 1,571,779 | 2/1926 | Allen | 362/303 |
| 4,298,916 | 11/1981 | Shemitz | 362/223 |
| 4,335,421 | 6/1982 | Modia et al. | 362/223 |
| 4,388,676 | 6/1983 | Sato et al. | 362/260 |
| 4,562,515 | 12/1985 | Lautzenheiser | 362/33 |
| 4,969,075 | 11/1990 | Helm et al. | 362/330 |

FOREIGN PATENT DOCUMENTS

| | | | |
|---|---|---|---|
| 10275 | 3/1990 | France | 362/297 |

*Primary Examiner*—Ira S. Lazarus
*Assistant Examiner*—Leonard Heyman
*Attorney, Agent, or Firm*—Dressler, Goldsmith, Shore, Sutker & Milnamow, Ltd.

[57] ABSTRACT

An improved undershelf elongated task light fixture. The fixture includes an elongated housing means having a top, a front wall depending from the top, and a back wall depending from the top and spaced rearwardly of the front wall. A tubular lamp is positioned in the housing between the front wall and the back wall. An elongated shield having a rearwardly facing, downwardly and rearwardly inclined reflector element is mounted on the housing. The shield lies beneath, and extends forwardly of, the tubular lamp. The housing and shield define an elongated opening adjacent the base of the housing between the front wall and the tubular lamp. A light diffuser, such as a batwing diffuser, covers the opening. The elongated shield substantially blocks direct radiation from the tubular lamp from impinging on the light diffuser, hence prevents veiling reflections almost entirely.

6 Claims, 2 Drawing Sheets

Fig. 1
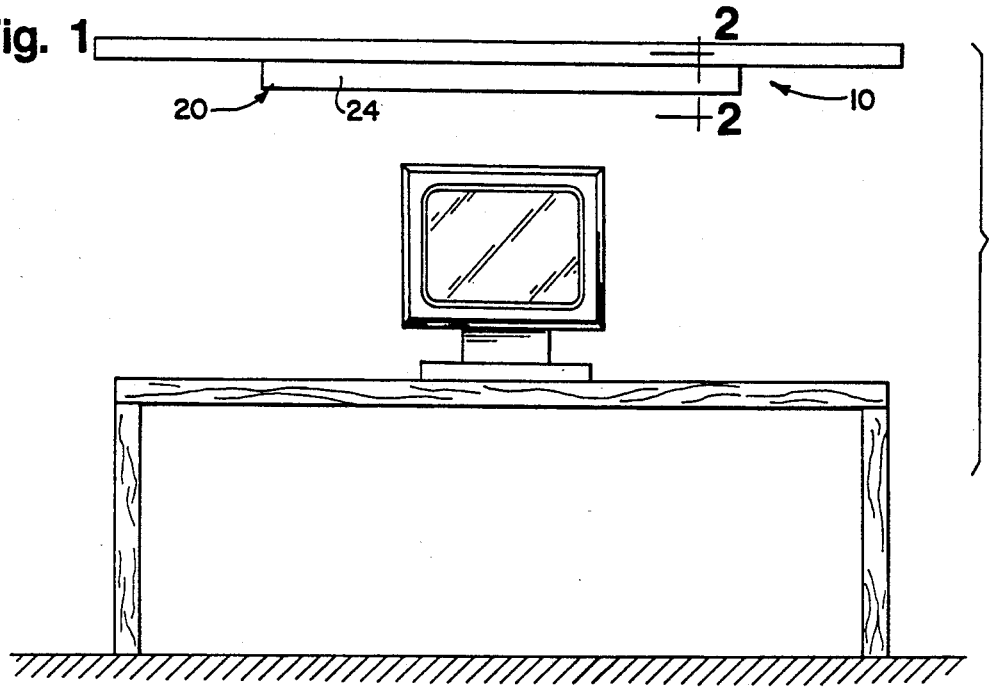
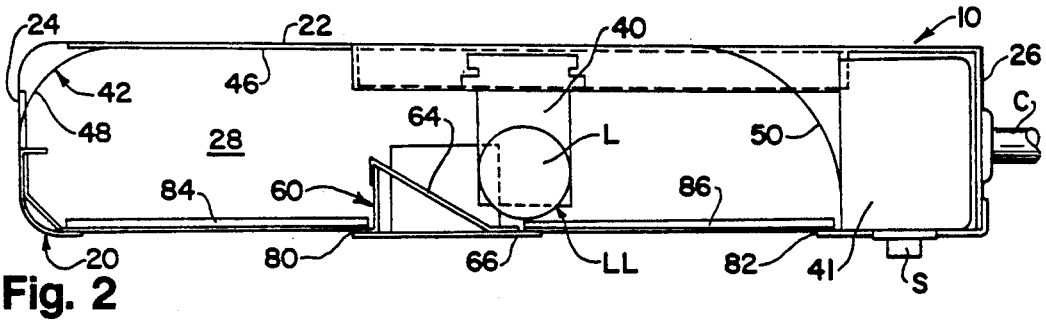
Fig. 2
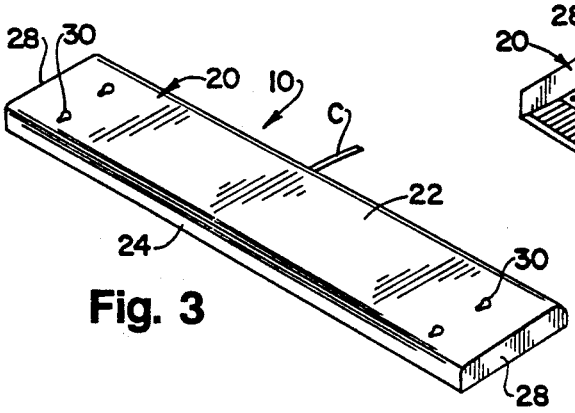
Fig. 3
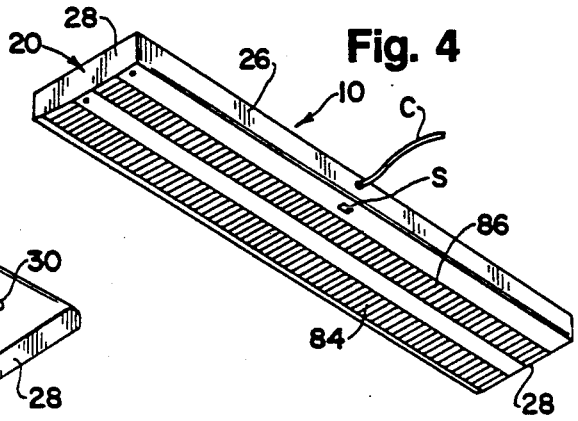
Fig. 4

UNDERSHELF TASK LIGHT FIXTURE

BACKGROUND OF THE INVENTION

Undershelf task lights are widely used as fixtures for work surfaces such as desks, computer tables and the like. Typically they are elongated assemblies which are two, three, four or more feet in length, and are mounted to a lower surface of a shelf or overhang. They are typically spaced 15 inches to two feet above the underlying work surface.

Despite the use of diffusers of various types, such task lights frequently produce excessive glare, both direct glare into the user's eyes and reflected glare which is sometimes referred to as veiling reflections. Because the ability to see a task depends on the contrast or brightness difference between detail and the background for the detail (such as the contrast between the information on a page and the background provided by the page), it is important that the light source either enhances the contrast or reduces the contrast as minimally as possible.

If the light impinging on a task reflects equally off detail and background, information is obscured. Where direct or reflected glare is a problem, increasing the quantity of light simply increases the direct glare, the reflected glare, or both. Thus, when a task light must be placed where reflected glare at some locations of its use will be a problem, neither increasing light intensity nor the use of conventional diffusers, such as batwing or other diffusers, will reduce veiling reflections to as great a degree as would be desirable.

Thus, an undershelf task light fixture having reduced reflected glare, i.e. reduced veiling reflections throughout the entire work area, would be desirable.

SUMMARY OF THE INVENTION

In accordance with the present invention, an improved undershelf task light fixture is provided. The fixture includes an elongated housing means having a much greater length than depth. The housing means has a top, a front wall depending from the top, and a back wall depending from the top and spaced rearwardly of the front wall. The top, the front wall and the back wall each run substantially the full length of the housing means. The housing means mounts, and provides power for, an elongated tubular lamp. The lamp runs lengthwise of the housing to position the tubular lamp in a location between the front wall and the back wall.

An elongated shield having a rearwardly facing, downwardly and rearwardly inclined reflector element is mounted on the housing means. The shield runs lengthwise of the housing means, with the shield lying beneath, and extending forwardly of, the tubular lamp location. The housing means and shield define an elongated opening adjacent the base of the housing means between the front wall and the tubular lamp location. The opening runs lengthwise of the housing means. A light diffuser covers the opening. The elongated shield substantially blocks direct radiation from the tubular lamp from impinging on the light diffuser.

In a preferred form the housing means and the shield define a second elongated opening running lengthwise of the housing means adjacent the back wall. A second light diffuser covers the second opening, with the elongated shield extending rearwardly of the front of the tubular lamp location a distance greater than half the width of any associated tubular lamp.

Desirably the housing means includes reflector means running lengthwise of the housing means, the reflector means being disposed along the top of the housing means. The reflector means may comprise an inserted reflector. The most preferred diffusers are batwing diffusers.

Further objects, features and advantages of the present invention will become apparent from the following drawings and description.

BRIEF DESCRIPTION OF THE DRAWINGS

FIG. 1 illustrates a work station with a task light of the present invention in a customary location;

FIG. 2 is a cross-sectional view of the task light of FIG. 1;

FIG. 3 is a top perspective view of the housing of the task light of FIG. 1;

FIG. 4 is a bottom perspective view of the task light of FIG. 1; and

DETAILED DESCRIPTION

Figure 5:
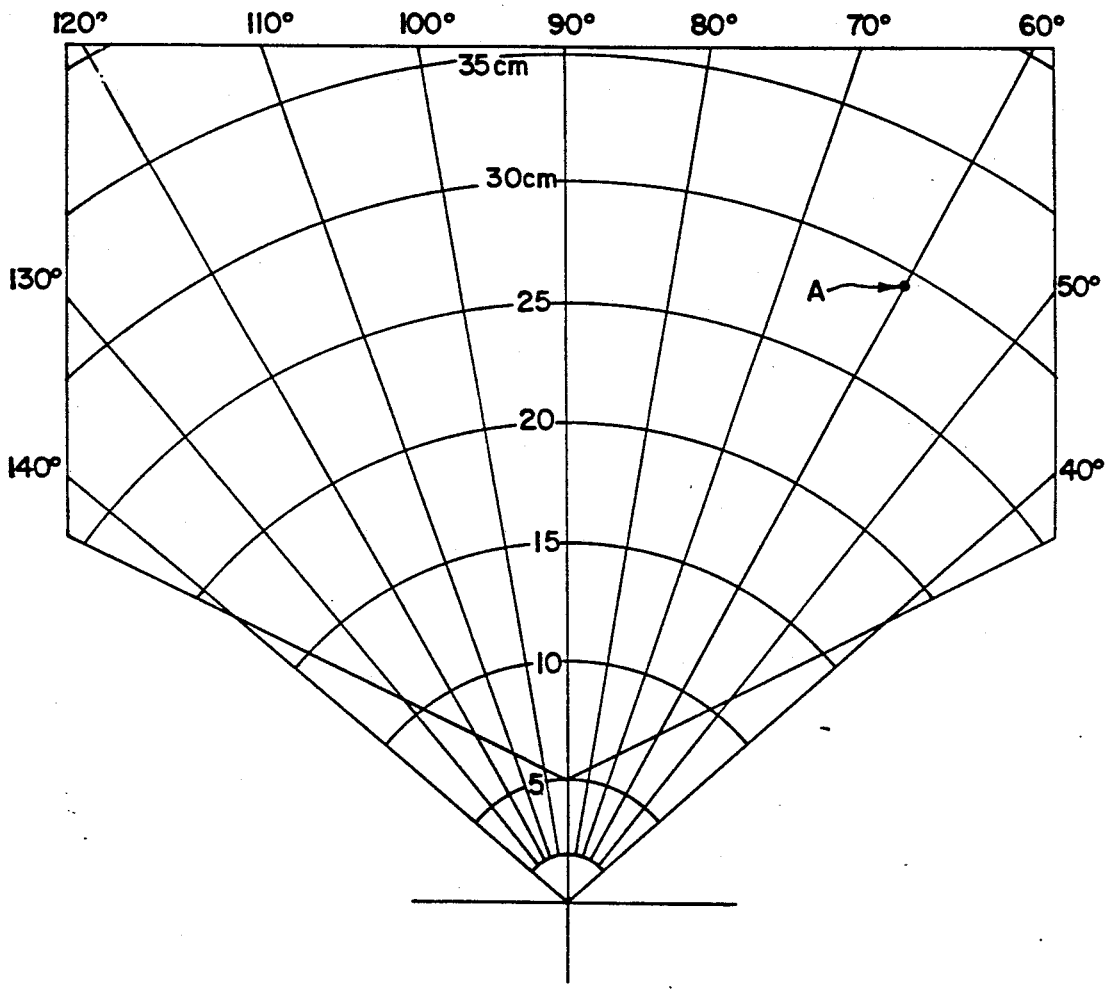
FIG. 5 is a Brüel and Kjaer chart illustrating the typical contrast reduction obtainable with a task light of the present invention.

Referring now to the drawings, a presently preferred embodiment of an undershelf elongated task light fixture 10 of this invention may comprise a housing means such as a housing 20 having a much greater length than depth. The housing includes a top 22 and a front wall 24 depending from the top. A back wall 26 also depends from the top and is spaced rearwardly of the front wall 24. The top, front wall and back wall run substantially the full length of the housing. The housing is also provided with end walls 28. The housing is adapted to be mounted beneath a shelf, as via screws which may cooperate with keyhole slots 30 provided in the top 22 in a known manner.

The interior of the housing 20 may be conventional in most respects. Thus the housing provides at least one opposed pair of conventional power sockets 40 which are slotted to mount and power an elongated tubular lamp L running lengthwise of the housing, thereby to position the tubular lamp L in a lamp location LL between the front and back walls. The housing 20 also mounts a ballast 41, such as an H.P.F. Octron ballast, which is powered by a power supply cord C and which may be activated, as by an on/off rocker switch S.

The housing interior is preferably highly reflective, and to that end may have all of its interior surfaces, such as the surfaces of the front wall, the back wall, the top and the end walls coated with a reflective white paint which acts as a diffusing reflector. Additionally, an inserted reflector 42 which runs lengthwise of the housing between the end walls may be used. The inserted reflector 42 may be of a white vinyl plastic and may comprise a generally flat upper central section 46, a downwardly curved concave front section 48, and a downwardly curved, concave rear section 50. Rear section 50 tends to reflect light forwardly and downwardly to help provide greater light output. Desirably the finish of the inserted reflector 42 is such that the light passing through the batwing diffuser is diffuse, i.e., that the batwing lens behaves as a diffuse batwing.

In accordance with the present invention, the housing 20 is also provided with an elongated shield 60 which runs lengthwise of the housing, and which is strategically located to provide the advantages of the present invention. Shield 60 includes a reflector element 64 which faces rearwardly and which is downwardly and rearwardly inclined. Preferably its reflective surface is coated with a white finish to provide a diffuse reflecting surface. The shield 60 includes a further rear element 66 which also runs lengthwise of the housing and which extends rearwardly.

The shield 60 is located between the front and back walls, and, with the housing, defines first and second housing openings 80, 82 running lengthwise of the housing. The openings are covered by diffusers, such as batwing diffusers 84, 86. Although batwing diffusers are preferred and produce the best results, other diffusers, such as other prismatic diffusers may be used as well.

As may be appreciated best from FIG. 2, the lamp location LL is located such that no direct radiation from the tubular lamp L will impinge on the batwing diffuser 84. The shield and reflector element 64 prevent that. The shield element 66 is located so that it extends rearwardly of the front of the tubular lamp location LL a distance greater than half of the width of the associated tubular lamp, and preferably at least three-quarters of the width of the associated tubular lamp. As such, the shield 60 and element 66 serve to block most direct radiation from projecting forwardly through diffuser 86. Thus the only light which passes through diffuser 84 is reflected light and substantially all of the light which passes downwardly and forwardly through the rear batwing diffuser 86 is reflected light as well.

In a preferred embodiment, the housing may be 10.5 inches in depth and 2 inches high. The inserted reflector 42 may be sized substantially as illustrated by FIG. 2. The housing may define two openings over which batwing diffusers are positioned as on appropriate edges of the housing defining the openings. Each opening may be three inches deep and may provide suitable stops to maintain the batwing diffusers in position, with the batwing prisms facing upwardly and extending from front to rear. The first opening may commence about ⅝ inch from the front wall and the second opening may commence about 1¾ inches forwardly of the rear wall. The shield and reflector element may be about 2-1/16 inch in dimension from front to rear when viewed from the bottom. The rearwardly inclined reflector element may commence about ⅛ inch rearwardly of the front edge of the shield and may be about 1-7/16 inches in length from its upper forward edge to its rearward lower edge and may be inclined downwardly at an angle of about 30 degrees from the horizontal. The shield element 66 may extend rearwardly about 11/16 inch, to a point which is spaced to cover about three-quarters of the width of the tubular lamp. A suitable tubular lamp may be a one inch diameter T8/31K Octron lamp. The length of the housing may vary, and in preferred forms may be nominally 2, 3, 4 and 6 feet in length.

As will be apparent from the foregoing, the task light 10 of the present invention provides task level illumination which eliminates both direct and reflected glare on horizontal tasks. That results in higher task contrast, and, thus, high visual performance. This results from the presence of the shield that provides multiple functions.

The shield functions to block a direct view of the lamp, and eliminates any potential for direct glare when the task light is mounted above eye level. The shield also blocks any direct illumination from striking a horizontal task below the fixture, and thus eliminates any reflected glare off the task. The inside of the shield reflector element 64 utilizes a highly reflective diffuse finish to direct light that strikes this surface back into the fixture to be redirected by the upper reflective surfaces.

The internal white reflector both diffuses the direct output of the lamp and redirects light out of the fixture through the two parallel openings described. These openings preferably contain identical acrylic batwing, or lenticular lenses. These lenses, which refract light, minimize light exiting the luminaire at nadir and angles near vertical, further reducing any potential for reflected glare off a horizontal task therebelow. The front lens refracts all indirect light from within the fixture No direct light from the lamp passes through this lens. The rear lens refracts indirect light forward, toward typical task locations, and direct light is primarily limited to passing through the lens toward the rear of the fixture, to illuminated vertical surfaces behind the fixture and away from task locations. Virtually all task illumination is provided indirectly, reflecting off internal reflectors prior to passing through either of the batwing lenses.

A typical task light in accordance with this invention was tested. The results demonstrated that a significant reduction in reflected glare off horizontal tasks was obtained.

A 48 inch fixture substantially as illustrated in the drawings hereof was positioned at a height of 15 inches over a horizontal work surface. A back vertical surface 14 inches from the front edge of the fixture was present. An F032 fluorescent tubular lamp was used. A Brüel and Kjaer Luminance Contrast Meter was used to map the work surface, measuring potential task contrast. As shown by the Brüel and Kjaer Chart, FIG. 5, a maximum contrast reduction of only 23% was obtained with the tested fixture at substantially a single point, point A, at 29.0 centimeters, 60°. This demonstrates the improved characteristics of the present invention, as compared to task lights currently available which have substantially higher contrast reductions. This low level of reflected glare will result in better visual performance than with conventional, available undershelf task light fixtures.

From the foregoing it will be apparent to those skilled in the art that further modifications may be made and provided without departing from the spirit of the invention. Accordingly, the scope of the invention is to be considered as being limited only to the extent made necessary by the claims.

What is claimed is:

1. An undershelf elongated task light fixture comprising a housing means having a much greater length than depth, said housing means having a base, a top, a front wall depending from said top, and a back wall depending from said top and spaced rearwardly of said front wall, said top, said front wall and said back wall each running substantially the full length of said housing means, means in said housing means for mounting and powering an elongated tubular lamp to position said tubular lamp in a location between said front wall and said back wall, said lamp running lengthwise of said housing means, an elongated shield having a rearwardly facing, downwardly and rearwardly inclined reflector element in said housing means running lengthwise of said housing means, said shield lying beneath, and extending forwardly of, said tubular lamp location, said housing means and shield defining an elongated opening adjacent the base of said housing means between said front wall and said tubular lamp location, said opening running lengthwise of said housing means, and a light diffuser covering said opening, said elongated shield substantially blocking direct radiation from said tubular lamp from impinging on said light diffuser.

2. A task light fixture in accordance with claim 1 and wherein said housing means and shield define a second elongated opening adjacent said back wall, said second opening running lengthwise of said housing means, a second light diffuser covering said second opening, said elongated shield extending rearwardly of the front of said tubular lamp location a distance greater than half of the width of any associated tubular lamp.

3. A task light fixture in accordance with claim 1, and wherein said housing means includes reflector means running lengthwise of said housing means and being disposed along said top of said housing means.

4. A task light fixture in accordance with claim 3, and wherein said reflector means comprises an inserted reflector.

5. A task light fixture in accordance with claim 1, and wherein said diffuser is a batwing diffuser.

6. A task light fixture in accordance with claim 2, and wherein said diffusers are batwing diffusers..

* * * * *